US005806153A

United States Patent [19]

Dolan et al.

[11] Patent Number: 5,806,153

[45] Date of Patent: Sep. 15, 1998

[54] LACE HAVING EXPANDABLE AGLETS AFFIXED THERETO

[75] Inventors: Dana Dolan, East Hampton, N.Y.; Jose R. Matos, Plano, Tex.

[73] Assignee: Lulirama International, Inc., Dallas, Tex.

[21] Appl. No.: 797,093

[22] Filed: Feb. 7, 1997

[51] Int. Cl.[6] ..... A43C 1/00

[52] U.S. Cl. ..... 24/715.4; 24/712.1; 24/713; 24/715.5

[58] Field of Search ..... 24/715.4, 712.1, 24/712.3, 712.9, 713, 300, 3.13, 17 B, 17 AP, 30.5 P; 40/636; 446/118, 119, 490

[56] References Cited

U.S. PATENT DOCUMENTS

| | | | |
|---|---|---|---|
| D. 327,568 | 7/1992 | Dutkanych | D2/316 |
| 761,963 | 6/1904 | Hiller . | |
| 1,142,199 | 6/1915 | Olson | 24/713 |
| 1,150,616 | 8/1915 | Officer . | |
| 1,172,954 | 2/1916 | Derrenberger | 24/713 |
| 1,233,863 | 7/1917 | Fry . | |
| 1,245,965 | 11/1917 | Pratt | 446/119 |
| 2,004,702 | 6/1935 | Luttmann, Jr. | 24/143 |
| 2,612,135 | 9/1952 | Iny | 116/170 |
| 2,650,399 | 9/1953 | Torelli | 24/117 |
| 2,952,462 | 9/1960 | Planin | 273/157 R |
| 3,559,251 | 2/1971 | Wilson | 24/143 |
| 3,636,594 | 1/1972 | Faivre | 24/715.4 |
| 4,561,153 | 12/1985 | Matsui | 24/17 AP |
| 4,935,851 | 6/1990 | Wood | 362/103 |
| 4,991,273 | 2/1991 | Huttle | 24/712.1 |
| 5,287,601 | 2/1994 | Schweitzer et al. | 24/715.4 |
| 5,293,668 | 3/1994 | Tibiletti | 24/30.5 P |

FOREIGN PATENT DOCUMENTS

| | | | |
|---|---|---|---|
| 0200107 | 6/1923 | United Kingdom | 24/715.4 |

*Primary Examiner*—Victor N. Sakran
*Attorney, Agent, or Firm*—Rick Matos; Akin, Gump, Strauss, Hauer & Feld, L.L.P.

[57] ABSTRACT

The invention provides laces, such as shoelaces, having affixed to them repeatedly collapsible and expandable aglets which can form 2- or 3-dimensional objects. The aglets can advantageously be passed through an eyelet thereby making it possible for them to be permanently affixed to laces during their manufacture. Thus, a user need not purchase a lace and aglets separately and attach them to each other after lacing an article such as a shoe.

21 Claims, 2 Drawing Sheets

LACE HAVING EXPANDABLE AGLETS AFFIXED THERETO

FIELD OF THE INVENTION

The present invention relates generally to laces, and more specifically, to laces having collapsible and expandable aglets forming 3-dimensional objects, affixed thereto.

BACKGROUND OF THE INVENTION

Laces are generally used in shoes, garments, leather accessories, and other such items requiring facile adjustable tying and release means. Laces with fanciful decorations are typically used to enhance the appearance and aesthetic appeal of articles, such as shoes, employing them. New, more decorative laces are continually developed and successfully marketed reflecting an ever present need and demand for them.

Laces, in particular shoelaces, have been adorned in a variety ways as by coloration, printing of pictures and or words thereon, inclusion of light emitting devices therein (U.S. Pat. No. 4,935,851 to Wood), construction with different synthetic, natural and metallic fibers, inclusion of coils or springs therein (U.S. Pat. No. DES 327,568 to Dutkanych) and the like.

Shoelaces have also been adorned with a variety of 2- and 3-dimensional objects. U.S. Pat. No. 2,650,399 to Torelli discloses knot retainers through which shoelaces are laced to aid in maintaining shoelaces tied. U.S. Pat. No. 4,991,273 to Huttle discloses elastic shoelaces with decorative fastenings through which the shoelaces are laced.

Fixture of 3-dimensional objects, i.e. aglets, onto lace ends is also known. The Iny patent (U.S. Pat. No. 2,612,135) discloses miniature bells as aglets which are affixed onto the ends of shoelaces once the laces have been laced through the eyelets of a shoe. The bells are snapped onto the shoelace ends by employing a ball & socket type configuration.

Wilson (U.S. Pat. No. 3,559,251) discloses a variety of 3-dimensional objects affixed to the ends of shoelaces. These aglets employ another ball & socket type configuration for attachment purposes.

Thus, the art establishes the need for improved laces having aglets that form 2- or 3-dimensional objects; however, none of the known laces have aglets that are collapsible, expandable and sufficiently small to fit through an eyelet of a shoe, and all of the known aglets which are 3-dimensional objects require assembly subsequent to lacing of a shoe.

Absorbent materials, such as natural sponge or poly(vinyl alcohol) based sponge, are used as toys. Such materials expand when placed in water to form a preconfigured object. For example, a sponge in the shape of a duck can be collapsed, and when immersed in water, the sponge will expand to form the preconfigured duck. When the sponge toy dries, it will shrink only a small degree and generally remain approximately the same size wet or dry. These sponge toys do not completely collapse to their original size after drying without the use of a machine.

U.S. Pat. No. 2,952,462 to Planin discloses machine collapsed sponge toys that can be placed in water and expanded to form preconfigured, generally flattened 2- or 3-dimensional objects such as puzzles, animals, balls and cylinders. When collapsed, such objects generally have a width that will not permit them to be passed through the eyelet of a shoe. These sponge toys also cannot be completely collapsed to their original size without the use of a machine.

There is no teaching or suggestion in the art of the invention as described and claimed herein. Due to the ever present demand for shoelace novelties, there remains a need for a laces providing new decorative features.

SUMMARY OF THE INVENTION

The present invention overcomes the disadvantages of known laces having an aglet which forms a 2- or 3-dimensional object and also includes novel and particularly advantageous embodiments. Thus, the present invention is generally directed to a lace having a repeatedly collapsible and expandable aglet affixed thereto, which aglet can be laced through the eyelet of a shoe, article of clothing or other article. The 2- or 3-dimensional objects formed by the aglet of the invention includes buildings, people, animals, food, toys, weapons, machinery, caricatures, fanciful figures, logos, letters, spaceships, and air, land or water borne vehicles, and the like.

One particularly advantageous feature of the collapsible and expandable aglets herein is that they can be permanently attached to a lace prior to lacing through the eyelets of an article. This feature facilitates use and adds value to laces which up to now have ornamentation limited in size to that which approximates the hole of an eyelet.

Another particularly advantageous feature of the collapsible and expandable aglets herein is that they are repeatedly collapsible and expandable. For example, when water expandable material is disposed within the aglet of the invention, the material can be repeatedly hydrated (expanded) and dehydrated (collapsed) to their original size as desired without the need for a machine. No other known aglets have this unique feature.

In one aspect, the invention provides a lace having an ornamental or decorative object affixed thereto. Thus, one embodiment of the invention is a lace having, affixed thereto, a repeatedly collapsible and expandable aglet comprising a shell and a collapsible and expandable material disposed within the shell, said aglet being capable of forming an expanded 2- or 3-dimensional object and of being laced through an eyelet.

It is contemplated that the shell can comprise water permeable or water impermeable materials, and that the lace can serve as a wicking agent to bring a solvent or water into the aglet. The collapsible and expandable material in the aglet can be repeatedly collapsed and expanded without a machine. The collapsible and expandable material can be water expandable and collapsing agent collapsible.

In another aspect, the invention provides a lace accessory, such as an aglet, which is repeatedly collapsible and expandable. Thus, in another embodiment, the invention is a repeatedly collapsible and expandable lace accessory capable of forming an expanded 2- or 3-dimensional object and of being laced through an eyelet, said lace accessory comprising a shell and a collapsible and expandable material disposed therein.

Yet another aspect of the invention comprises an aglet comprising a shell, a repeatedly collapsible and expandable material disposed within said shell, and a removable retaining member, disposed adjacent said shell, for maintaining said aglet in a coiled position about the lace prior to passage through an eyelet. It should be understood that the removable retaining member is intended to maintain an aglet in the coiled position only temporarily.

It is contemplated that the lace accessory can be an aglet, knot retainer, or other object which is either affixed or attached to or pendant from a lace. The lace accessory of the invention is generally intended to be, but need not be, capable of passing through an eyelet when in the coiled position.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

The invention is a repeatedly collapsible and expandable aglet for a lace comprising a shell and a collapsible and expandable material disposed within the shell. When collapsed and affixed to the end of a lace, the aglet can pass through an eyelet; therefore, there is no need for attachment of the aglet subsequent to passage through an eyelet. If necessary, the aglet can be coiled to facilitate insertion through the eyelet. The term "coiled", as used herein, refers to any operation whereby the collapsed aglet is rolled, wrapped or folded in a geometry suitable for passing through the eyelet.

The lace of the invention can be any commercially available lace and generally comprises any natural, synthetic, leather or metal fiber and/or cloth. It can be adorned with any of a number of decorations.

Figure 1A:
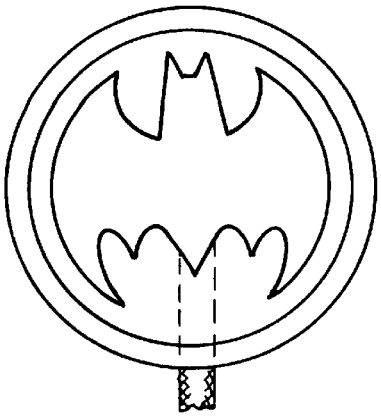
FIGS. 1*a*–1*f*—six exemplary embodiments of the collapsible and expandable aglet and lace of the invention.
Figure 1B:
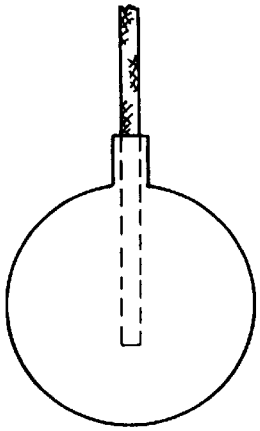
Figure 1C:
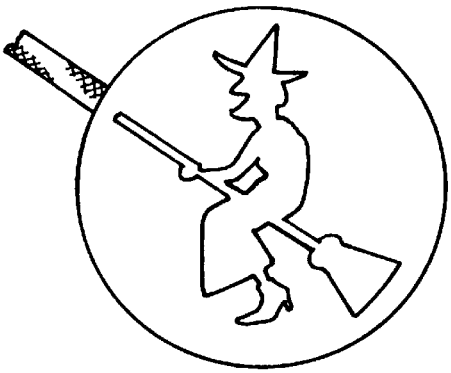
Figure 1D:
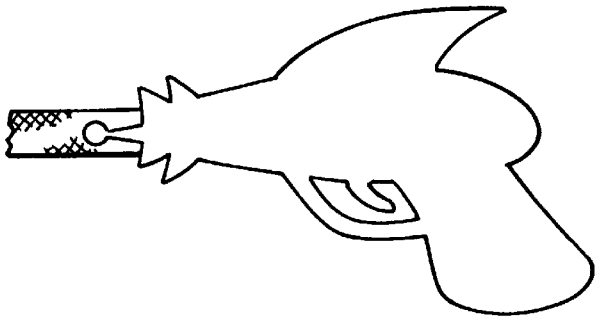
Figure 1E:
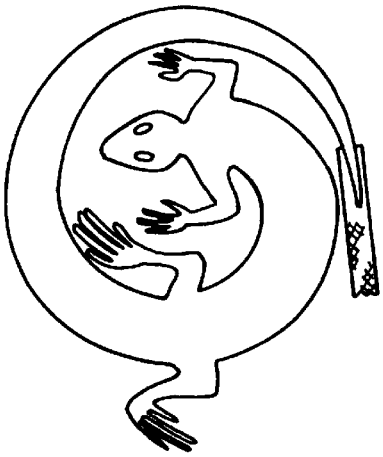
Figure 1F:
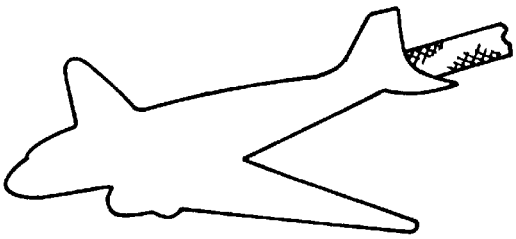

By "aglet" is meant a 2- or 3-dimensional object which is or can be attached to an end of a lace. The aglet of the invention can be in the shape of essentially any known objects including, by way of example and without limitation, buildings, people, animals (FIG. 1*e*), food, toys, weapons (FIG. 1*d*), sporting goods (FIG. 1*b*), machinery, caricatures (FIG. 1*c*), fanciful figures, logos (FIG. 1*a*), letters, spaceships, and air, land or water borne vehicles (FIG. 1*f*), and the like.

By "collapsible and expandable" is meant capable of being collapsed and expanded. By "collapsible" is meant can be collapsed from a larger, i.e., expanded, 2- or 3-dimensional object to a smaller 2- or 3-dimensional object. By "expandable" is meant capable of forming an expanded 2- or 3-dimensional object. The aglets of the invention are generally repeatedly collapsible and can be collapsed and expanded without the use of a machine.

A "collapsible and expandable material" is capable of existing in either the collapsed or expanded form. Such materials include any which will expand when treated in a first manner and collapse when treated in a second manner. The collapsible and expandable material comprises starch grafted poly(acrylic acid), a starch derivative, a cellulose derivative, a superabsorbent agent, poly(vinyl alcohol), poly (alkyl amine), poly(acrylamide) amine derivative, a hydrogel, poly(acrylic acid), microbial cellulose, poly (vinyl pyrrolidone) or combinations and/or salts thereof.

In a preferred embodiment, the collapsible and expandable material will be water expandable, i.e. expandable by exposure to or treatment with water, and will be collapsible by removal of water by exposure to or treatment with a collapsing agent. By "collapsing agent" is meant any agent, chemical, condition, process or compound which will collapse a collapsible and expandable material. Collapsing agents contemplated herein include, by way of example and without limitation, salt, heat, dry air, evaporation, compression, water miscible organic solvent, acetic acid, salt solution, bicarbonate or carbonate solution, alcohol, ethanol, isopropanol and others. By "water miscible" is meant can be dissolved in water or will dissolve water.

In another preferred embodiment, the collapsible and expandable material will be in particulate, powdered, agglomerated, amorphous, crystalline or other solid form when collapsed. These forms are particularly advantageous as they permit the expanded material to adapt to and fill the interior cavity of an aglet. These forms differ from conventional sponges which are molded and expand to a preconfigured form and cannot adapt to the shape of the shell of an aglet.

When collapsed and affixed to the end of a lace, the aglet of the invention is capable of being laced through an eyelet. However, when used as a lace accessory for attachment to a lace subsequent to lacing an article, the aglet of the invention need not fit through an eyelet when collapsed.

The shell of the aglet is intended to retain the collapsible and expandable material of the invention. The shell will be made of flexible and/or expandable materials such as, by way of example and without limitation, plastic, rubber, polymer, cloth, leather, paper, polyolefin, polyalkylene, polyester, polyamide, nylon, cotton, cellulose, polyurethane, latex, poly(ethylene terephthalate), polyethylene, polypropylene or any combination thereof.

According to the properties of the collapsible and expandable material used to make an aglet, the shell can be made of a substantially water impermeable or water permeable material. By "water impermeable" is meant a material, such as plastic or rubber film, that generally does not permit diffusion o.)f liquid water but might permit diffusion of water vapor. By "water permeable" is meant a material, such as porous plastic, rubber, paper, leather, film and cloth, that generally permits diffusion of liquid water and water vapor.

When an aglet comprises a shell made from a substantially water impermeable material and a collapsible and expandable material within the shell which is water or solvent expandable, the lace will serve as a wicking agent to draw water and/or solvent into the shell. By "wicking agent" is meant a material which will draw water from one area to another by way of capillary force. Use of a substantially water impermeable material for the shell will aid in retaining water or solvent within the shell and thus in maintaining the collapsible and expandable material expanded for an extended period of time.

When an aglet comprises a shell made from a substantially water permeable material and a collapsible and water or solvent expandable material within the shell, water or solvent can enter the shell through the lace to which the aglet is attached or through the shell itself. Use of a substantially water permeable material for the shell will permit relatively facile removal of water from the collapsible and expandable material within the shell by a collapsing agent and will permit more rapid collapse of the material.

Figure 2A:
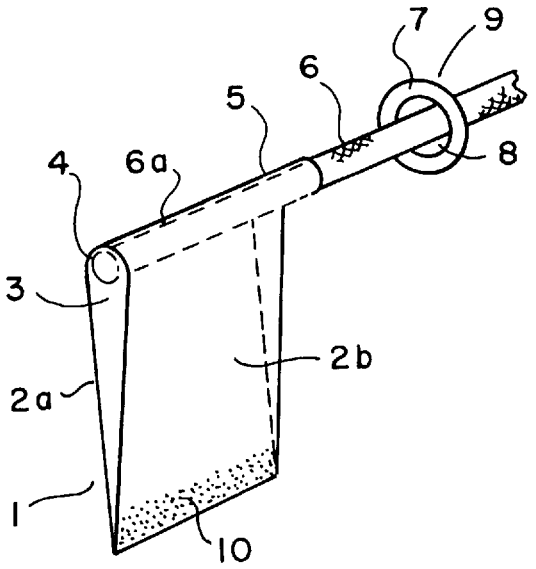
FIG. 2*a*—perspective view of a collapsed aglet embodiment and lace of the invention.

In one aspect, the aglets of the invention are generally constructed as shown in FIG. 2*a* which depicts one embodiment of collapsed aglet (1) in the shape of a flag. Aglet (1) comprises front surface (2*b*) and rear surface (2*a*) which together define internal cavity (3) and are disposed about and adjacent end (4) of lace (6). Aglet (1) also has cuff (5) which can substantially surround a portion of lace (6). Cuff (5) can be any length desired. Disposed within cavity (3) is collapsible and expandable material (10) depicted in the collapsed form. As shown, lace (6) has already been passed through eyelet (9) which comprises ring (7) that defines hole (8).

Aglet (1) is generally affixed to lace (6) by way of an adhesive disposed within cuff (5) or within cavity (3) along portion (6*a*) of lace (6). Collapsible and expandable material (10) is generally particulate and can be disposed anywhere within cavity (3). End (4) of lace (6) can be disposed within cavity (3) or outside of aglet (1). When disposed outside of aglet (1) as in FIG. 2*a*, end (4) can also serve as a wicking agent.

The embodiment of FIG. 2*a* shows collapsible and expandable material (10) which is water expandable but in the dehydrated (desiccated or dry) form. Here, the shell of aglet (1) comprises a substantially water impermeable material. Therefore, in order for water to enter into cavity (3) to expand material (10), it must do so by way of lace (6) which serves as a wicking agent.

Figure 2B:
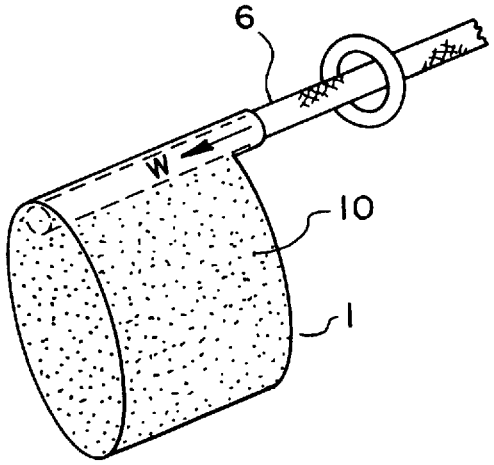
FIG. 2*b*—perspective view of an expanded aglet embodiment and lace of the invention.

When aglet (1) and a portion of lace (6) is immersed in water, the water can pass through cuff (5), as indicated by arrow (W), and into cavity (3). As depicted in FIG. 2*b*, collapsible and expandable material (10) expands to fill cavity (3) upon exposure to water. Since material (10) is generally I)articulate, it can adapt to fit and fill cavity (3) regardless of the shape of the cavity.

The loading of collapsible and expandable material (10) will depend upon the material's degree of swelling, i.e. the ratio of expanded size over collapsed size, the extent of cavity fill desired, the nature of the collapsing agent to be used, if necessary, and/or other considerations. Generally, the higher the degree of swelling, the lower the amount of material (10) needed to fill cavity (3).

Figure 3A:
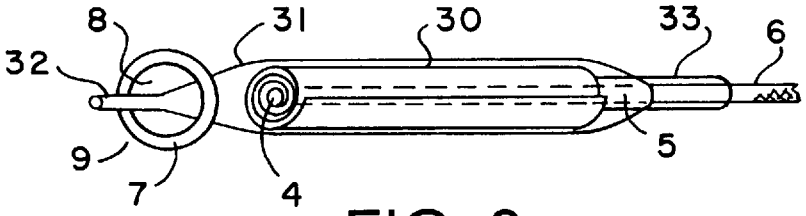
FIG. 3*a*—perspective view of a first embodiment of a collapsed, coiled and retained aglet and lace of the invention.

In order to facilitate passage through an eyelet, it may be necessary to wind or coil a collapsed aglet around a respective lace. FIG. 3*a* depicts another aspect of the invention wherein collapsed and coiled aglet (30) is generally substantially surrounded by removable retaining member (31). Aglet (30) is coiled or wound about lace (6) in order to minimize its size. Removable retaining member (31) generally closely surrounds coiled aglet (30) and can have first end (32) and second end (33). The diameter of retaining member (31) is sufficiently small to permit passing through hole (8) of eyelet (9). First end (32), which is proximal end (4) of lace (6), is generally, but not necessarily, tapered and smaller in diameter than the rest of removable retaining member (31). As depicted, removable retaining member (31) extends the entire length of aglet (30); however, this is not necessary. It is generally only required that removable retaining member (31) maintain aglet (30) in the coiled position during passage of said aglet through an eyelet.

Removable retaining member (31) can comprise paper, plastic, rubber, heat shrinkable material, tape, adhesive and any combination thereof. By way of example and without limitation, removable retaining member (31) can be a paper sleeve, a segment of tape, a rubber film, thread, string, fiber, heat shrink tubing and the like.

Figure 3B:
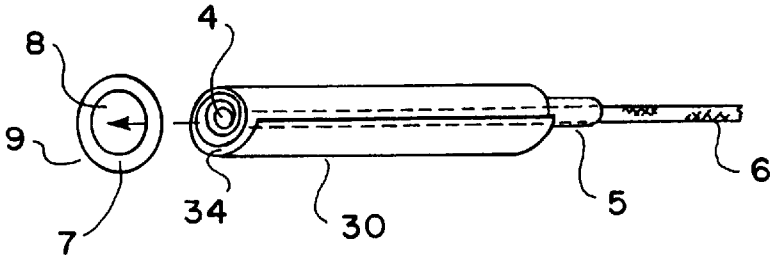
FIG. 3*b*—perspective view of a second embodiment of a collapsed, coiled and retained aglet and lace of the invention.

As depicted in FIG. 3*b*, removable retaining member (34) can be an adhesive disposed between coiled or wound layers of aglet (30) which maintains aglet (30) in the coiled position during passage of said aglet through eyelet (9). Adhesives generally useful as removable retaining members of the invention include, by way of example, water soluble or removable, water insoluble, repositionable, temperature sensitive, pressure sensitive and/or low adhesive strength adhesives. In a preferred embodiment, the adhesive is water soluble or removable. Thus, retaining member (34) can be removed by placing aglet (30) in water thereby permitting the approximately simultaneous removal or dissolution of retaining member (34) and expansion of a water expandable material (not shown) in aglet (30).

EXAMPLE 1

A lace having a repeatedly collapsible and expandable aglet affixed thereto was made as follows. Poly(ethylene terephthalate) film was cut and heat sealed according to the embodiment of FIG. 2*a*. A small portion of repeatedly collapsible and expandable material starch grafted polyacrylic acid (Aldrich Chemical Co., Milwaukee, WI) was placed within the aglet through its cuff. A first end of a commercial cotton/polyester shoelace adorned with writing and a school logo was inserted into the aglet through its cuff and attached with epoxy based adhesive. The aglet was colored with a marker to resemble a flag. It was then coiled, or wound, about the first end of the shoelace and inserted within a segment of heat shrink tubing, the retaining member. The ends of the tubing were heated to form the collapsed, coiled and retained aglet of FIG. 3*a*. After passing the retained aglet through the eyelet of a shoe, the heat shrink tubing was removed and the aglet placed in water. The lace served as a wicking agent, and after a period of time, the aglet swelled to form the configuration depicted in FIG. 2*b*. Subsequently, the aglet was allowed to dry, and, after a period of one week, the water within the aglet had evaporated and the repeatedly collapsible and expandable material had collapsed. The aglet was expanded again by treatment with water. Subsequently, the aglet was collapsed by treatment with a collapsing agent, table salt (NaCl) solution.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

Following long-standing patent law convention, the terms "a" and "an" mean "one or more" when used in this specification.

What is claimed is:

1. A lace having affixed thereto a repeatedly collapsible and expandable aglet comprising a shell and a repeatedly collapsible and water expandable material disposed within the shell, said aglet being capable of forming an expanded 2- or 3-dimensional object and of being laced through an eyelet.

2. The lace of claim 1, wherein said shell comprises one of flexible plastic, rubber, polymer, leather metallized fiber, metallized cloth and combinations thereof.

3. The lace of claim 1, wherein said shell comprises a substantially water impermeable material and said lace serves as a wicking agent.

4. The lace of claim 1, wherein said shell comprises a water permeable material.

5. The lace of claim 4, wherein the collapsible and expandable material comprises one of starch grafted poly (acrylic acid), a starch derivative, a cellulose derivative, a superabsorbent agent, poly(vinyl alcohol), poly(alkyl amine), poly(acrylamide) amine derivative, a hydrogel, poly (acrylic acid), microbial cellulose, poly(vinyl pyrrolidone) combinations thereof and salts thereof.

6. The lace of claim 4, wherein the collapsible and expandable material can be collapsed by one of removal of water and treatment with a collapsing agent.

7. The lace of claim 6, wherein the collapsing agent is one of salt, a salt-containing solution and a water miscible solvent.

8. The lace of claim 7, wherein the water miscible solvent is alcohol.

9. The lace of claim 1 further comprising a removable retaining member, disposed adjacent said shell, for temporarily maintaining said aglet collapsed, said aglet being operable to remain attached to a lace after the removable retaining member is removed.

10. The lace of claim 9, wherein said removable retaining member comprises one of plastic, rubber, thread, string, fiber, film, paper, heat shrinkable material, pressure sensitive adhesive, removable adhesive, water soluble adhesive, water insoluble adhesive, repositionable adhesive, temperature sensitive adhesive, low adhesive strength adhesive and combinations thereof.

11. A repeatedly collapsible and expandable lace accessory capable of forming an expanded 2- or 3-dimensional object, said lace accessory comprising a shell and a repeatedly collapsible and water expandable material disposed therein.

12. The lace accessory of claim 11, wherein said shell comprises one of flexible, plastic, rubber, polymer, leather, metallized fiber, metallized cloth and combinations thereof.

13. The lace accessory of claim 11, wherein said shell comprises a substantially water impermeable material and said lace serves as a wicking agent.

14. The lace accessory of claim 11, wherein said shell comprises a water permeable material.

15. The lace accessory of claim 14, wherein the collapsible and expandable material comprises one of starch grafted poly(acrylic acid), a starch derivative, a cellulose derivative, a superabsorbent agent, poly(vinyl alcohol), poly(alkyl amine), poly(acrylamide) amine derivative, a hydrogel, poly (acrylic acid), microbial cellulose, poly(vinyl pyrrolidone) combinations thereof and salts thereof.

16. The lace accessory of claim 14, wherein the collapsible and expandable material can be collapsed by one of removal of water and treatment with a collapsing agent.

17. The lace accessory of claim 16, wherein the collapsing agent is one of salt, a salt-containing solution and a water miscible solvent.

18. The lace accessory of claim 17, wherein the water miscible solvent is alcohol.

19. The lace accessory of claim 11, further comprising a retaining member disposed adjacent said shell for temporarily maintaining said lace accessory collapsed.

20. The lace accessory of claim 19, wherein said retaining member comprises one of plastic, rubber, thread, string, fiber, film, paper, heat shrinkable material, pressure sensitive adhesive, removable adhesive, water soluble adhesive, water insoluble adhesive, repositionable adhesive, temperature sensitive adhesive, low adhesive strength adhesive and combinations thereof.

21. An aglet comprising a shell, a repeatedly collapsible and water expandable material disposed within the shell, and a removable retaining member for temporarily maintaining said aglet collapsed, wherein said aglet can remain attached to a lace after the removable retaining member is removed.

* * * * *

UNITED STATES PATENT AND TRADEMARK OFFICE

CERTIFICATE OF CORRECTION

PATENT NO. : 5,806,153

DATED : September 15, 1998

INVENTOR(S) : Dana Dolan and Jose R. Matos

It is certified that error appears in the above-indentified patent and that said Letters Patent is hereby corrected as shown below:

Column 4, line 50, change "o.)f" to -- of --.

Column 5, line 39, change "I)articulate" to -- particulate --.

Column 7, line 2, insert a comma after "leather".

Signed and Sealed this

Twelfth Day of January, 1999

*Attest:*

*Attesting Officer*

*Acting Commissioner of Patents and Trademarks*